US005984051A

United States Patent [19]

Morgan et al.

[11] Patent Number: 5,984,051

[45] Date of Patent: Nov. 16, 1999

[54] REMOTE ELEVATOR CALL REQUESTS WITH DESCRIPTOR TAGS

[75] Inventors: Robert G. Morgan, Bolton; David Crenella, Berlin; Bruce E. Zepke, Glastonbury; Harold Terry, Avon, all of Conn.; Eric K. Jamieson, Bettendorf, Iowa

[73] Assignee: Otis Elevator Company, Farmington, Conn.

[21] Appl. No.: 09/188,846

[22] Filed: Nov. 9, 1998

[51] Int. Cl.[6] ..... B66B 1/20

[52] U.S. Cl. ..... 187/392; 187/384; 187/316

[58] Field of Search ..... 187/392, 391, 187/384, 316

[56] References Cited

U.S. PATENT DOCUMENTS

| | | | |
|---|---|---|---|
| 4,673,911 | 6/1987 | Yoshida | 187/100 |
| 4,685,538 | 8/1987 | Kamaike et al. | 187/121 |
| 4,979,594 | 12/1990 | Begle et al. | 187/121 |
| 5,689,094 | 11/1997 | Fredli et al. | 187/384 |
| 5,832,363 | 11/1998 | Moriya et al. | 455/11.1 |

*Primary Examiner*—Robert E. Nappi

[57] ABSTRACT

Remote control devices borne by potential passengers are alerted to initiate a request for elevator service by beacons in the building. The beacon alert message includes a tag identifying the floor on which the beacon is located and a position on the floor at which the beacon is located. The floor description tags prevent transmissions of the remote device from being recognized on floors other than the floor on which the device was alerted by a beacon, whereby transmission power of the remote devices may be quite high to assure reception anywhere on the floor, while being ignored on adjacent floors. Tags descriptive of the location on the floor (such as east, west, or lobby area) allow early assignment of a call to an elevator, without causing a car to stop for that particular passenger unless the call is verified by the passenger being sensed in the immediate vicinity of the elevator, and a car call is not entered for the destination floor unless the passenger is sensed as being within the elevator cab, due to a remote device message including a cab descriptor tag.

8 Claims, 6 Drawing Sheets

REMOTE ELEVATOR CALL REQUESTS WITH DESCRIPTOR TAGS

RELATED APPLICATION

Some of the matter disclosed herein is disclosed and claimed in commonly owned U.S. patent applications Ser. No. 09/189,161 filed contemporaneously herewith, Ser. No. 09/111,355 filed Jul. 7, 1998, and Ser. No. 09/111,077 filed Jul. 7, 1998.

TECHNICAL FIELD

This invention relates to elevator service calls transmitted by electromagnetic radiation between the elevator system and a portable device borne by a user, with tags in the message which identify the floor and/or other location of the place where transmitted, and/or the car to which a call is assigned.

BACKGROUND ART

Elevator systems have recently been provided with two features which are thought to save considerable passenger time and increase the carrying capacity of a given elevator installation. The first of these is utilizing destination calls, by which the passenger does not simply call an elevator to his floor, but at the same time informs the elevator of the intended destination floor. This allows the dispatcher (typically a suitably programmed computer) to allocate the call to the most appropriate car, taking into account not only the origin, but also the destination of the passenger.

A second feature causes passengers to enter their calls while still at some distance (equivalent to about ten seconds, in one case) from the elevator, whereby the dispatcher can attempt to cause the elevator to arrive at nearly the same time that the passenger reaches the elevator. The advance calls are entered either automatically by, or in response to pressing keys on, personal radio transmitters which transmit an identification (ID) number utilized to automatically enter a prearranged destination call or a key-selected call.

Typical problems with these systems include calls caused by the person desiring to go to a destination other than his passively-entered, prearranged destination, or deciding not to enter the elevator yet (such as to purchase a newspaper on the way in), or simply changing his mind. Another problem is establishing a correct level of transmission power. If a remote call device transmits with too much power, the call may be entered on the floor above or the floor below the floor on which the passenger carrying the device is located. On the other hand, if the power is too low, calls may not be registered in a desired remote location, thereby upsetting the call allocation scheme of such a system. If multiple receivers are used, then the system must be able to distinguish between independent requests, and an identical request received by more than one receiver. Furthermore, especially during busy periods on a busy floor, many remote devices may be transmitting at once. Although such devices may use conventional spread spectrum transmission or conventional randomly timed transmission to assure that each message will be distinctly recorded, separately from the others, mixup in transmitted messages as between requests for service, notification of call allocation, and the like should be mitigated to reduce the number of false calls.

DISCLOSURE OF INVENTION

Objects of the invention include improved remote entry of elevator calls; improved automatic entry of elevator calls; reducing false calls in an elevator system responding to remote calls; reducing the response to false calls in an elevator system employing automatic destination calls; providing improvements in elevator system operation; reducing elevator door dwell time; reduced elevator service time; and improved integrity in remote elevator service call transmissions and responses thereto.

In accordance with the present invention, electromagnetically transmitted messages, including requests for elevator service and responses to said requests, include a tag descriptive of some characteristic related to the request or its response. Such tags can include the floor on which a prompt beacon, for alerting a remote elevator call transmitting device, is located, and/or the region of the floor (east, north, lobby) where the beacon is located, or that the beacon is located within the cab of a particular elevator; in turn, the device responding to the beacon will include the beacon identification in any message that it transmits in response to being alerted by that beacon, whereby the location of the message transmission becomes known. In accordance further with the invention, any messages transmitted with respect to a particular request for elevator service may include a tag identifying the elevator car to which such request has been assigned, after the assignment thereof.

The present invention allows utilization of remote elevator call requests to be transmitted with adequate power to reach a single reception point in the building, without the potential for being sensed on more than one floor at a time, thereby eliminating the need for and complexity of a system employing multiple receivers to assure reception of all remote requests.

The invention permits simplification of dispatching in response to remote elevator call request messages, provides enhanced reliability to call assignments based upon remotely transmitted requests, allows improved elevator car operation in a system employing remote elevator call request transmitters, allows reduced door dwell time and improves system handling capacity with reduced passenger waiting time.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
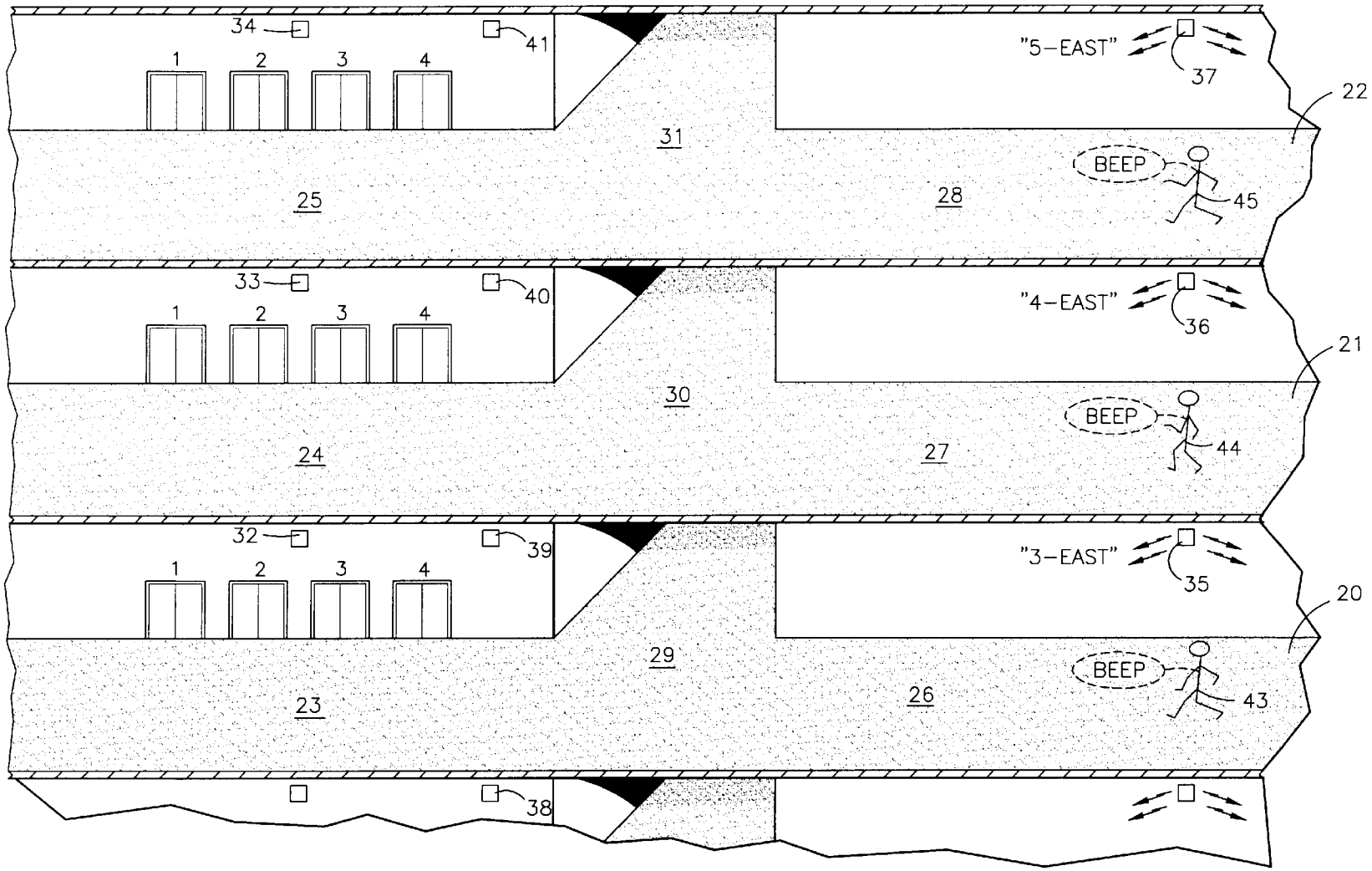
FIGS. 1–4 are partial, partially sectioned, perspective views of three floors of a building, illustrating a sequence of operation of the present invention as various persons approach elevator lobbies.
Figure 2:
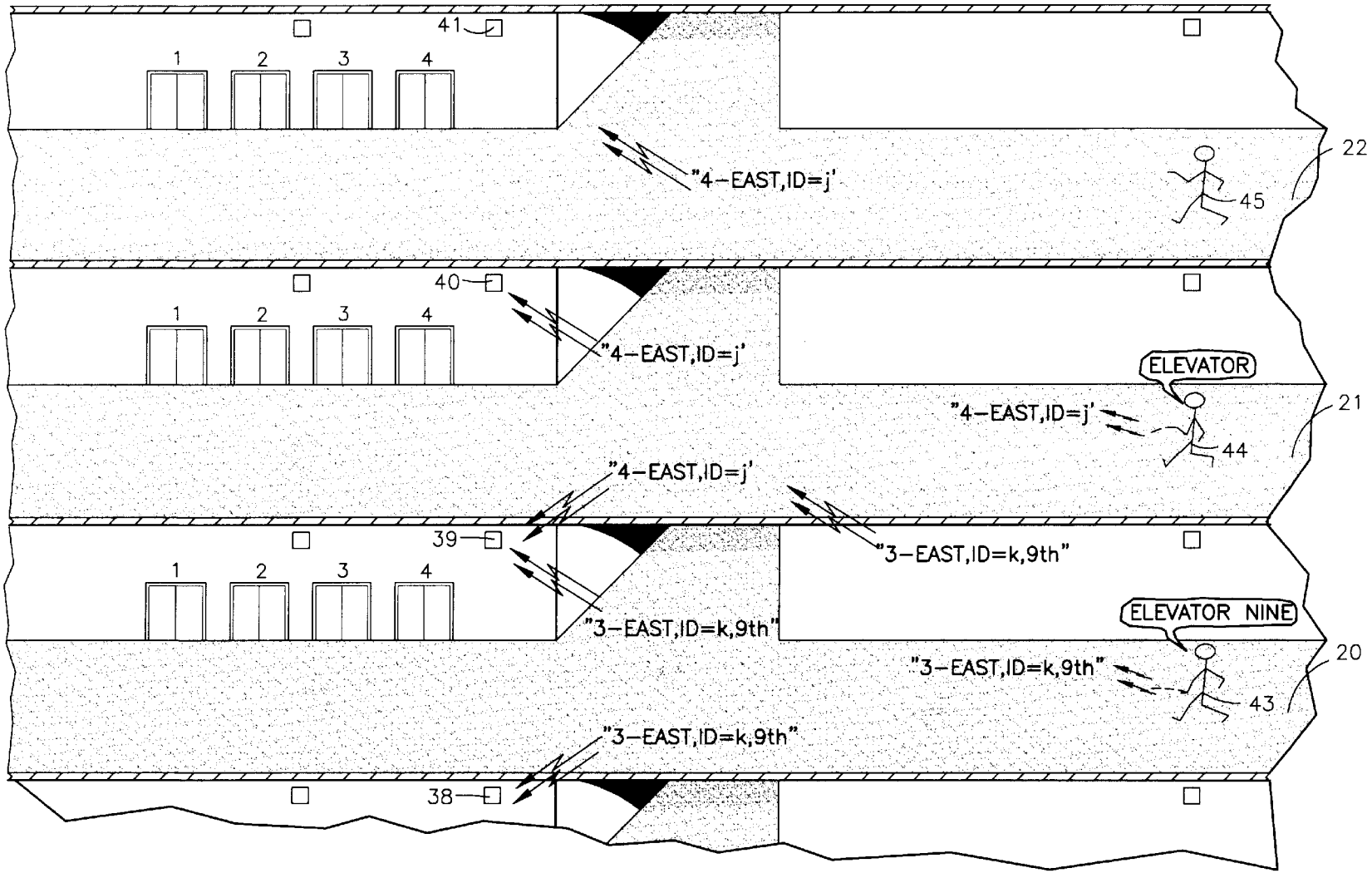

Referring now to FIG. 1, three floors of a building 20–22, each include an elevator landing 23–25, corresponding entrance corridors 26–28, and other corridors 29–31. Each of the corridors 26–28 has corresponding prompt beacons 32–37 that periodically (several times per second) transmit a prompt to alert personal devices carried by passengers (not shown in FIG. 1) that the general proximity of the elevators has been reached. The prompt is electromagnetic radiation, which may be selected from various available bands, such as 125 KHz or 315 MHz. Each of the elevator landings 23–25 has an electromagnetic transceiver 39–41 which can both transmit and receive messages by means of electromagnetic radiation. In FIG. 1, three persons 43–45 are shown entering corresponding corridors 26–28 at a time when each prompt transmitter 35–37 is transmitting an electromagnetic signal which comprises a beacon type prompt. Each person 43–45 is bearing a remote control device not shown in FIGS. 1–6 for clarity. The remote control devices may take the form of a verbal device described with respect to FIG. 9 of aforementioned application Ser. No. 09/111,070, or a keyed device described with respect to FIG. 10 of said application. In response to the beacon prompt, each verbal remote control device (in the example of FIG. 1) will issue an audible prompt, such as a beep (FIG. 1), for the person bearing the device to hear. In response to the audible prompt, as is shown in FIG. 2, the persons 43 and 44 desirous of entering an elevator will respond verbally. On the fourth floor, the person 44 simply says "elevator", which causes the verbal remote control device borne by him to transmit, electromagnetically, a message which includes information such as "elevator requested", the name of the beacon to which the device is responding (either 3-EAST or 4-EAST in the example) the identification number of the device (either k or j in the example of FIG. 2), and whether or not the bearer has indicated a desire to go to a floor other than the floor that the bearer normally goes to, referred to as the default floor herein. As seen in FIG. 2, it is assumed that the person 43 has requested the elevator to take him to the ninth floor, whereas the person 44 has requested the elevator, and decides to go to his default floor. In FIG. 2, the person 45 has said nothing, thereby indicating that he is not heading for the elevator. Alternatively, when prompted by the transceivers 35–37, the verbal remote control devices borne by the persons 43–45 might have synthesized the question "Elevator?", instead of using "beep" as a prompt. In reply to the request, the person 43 could have replied "yes . . . 9" or simply "9", and the person 44 could have simply replied "yes". In a system so devised, the person 45 might either remain silent or answer with the word "no". Optionally, the persons might use functional words to enter a specific call, such as "gym", "office" or "cafeteria". If desired, any human-discernable prompt, such as vibration (as in conventional paging units) may be used instead of audible prompts.

When each verbal remote control device has received a verbal reply from the person who is carrying it, it will transmit a corresponding message to a landing transceiver 39, 40, 41 (or a receiver positioned in any other suitable way), which includes the location of the beacon, the ID number of the device (person) and any request for a destination floor different from the default floor. In FIG. 2, the device borne by person 43 transmits a message identifying the person as that person on the east end of the third floor, having an assigned ID=k, and requesting service to the 9th floor; the device borne by person 44 transmits a message that identifies the bearer as being on the east end of the fourth floor, having ID=j. The device on person 45 does not transmit any response, in this example.

In FIG. 2, the message "3-EAST , ID=k, 9th" is illustrated as being not only transmitted to the transceiver 39 on the third floor 20, but also being transmitted to the transceiver 38 on the floor below the third floor 20 and being transmitted to the transceiver 40 on the fourth floor 21. This illustrates the possibility of a transmission on a given floor being of sufficient power, in order to reach from any part of that floor to the transceiver of that floor, such that the transmission will also pass through the building structure to adjacent floors. A major feature of the present invention is that because of the beacon tag "3" and "4", each transceiver 38–41 will only respond to messages bearing a tag identifying the appropriate floor number.

Similarly, the tag "EAST" in each of the messages of FIG. 2 indicate that the passenger is located remotely of the elevator, and is not in a position to receive elevator service, as yet. This is another aspect of the invention, which is covered in the aforementioned copending application Ser. No. 09/189,161.

Figure 3:
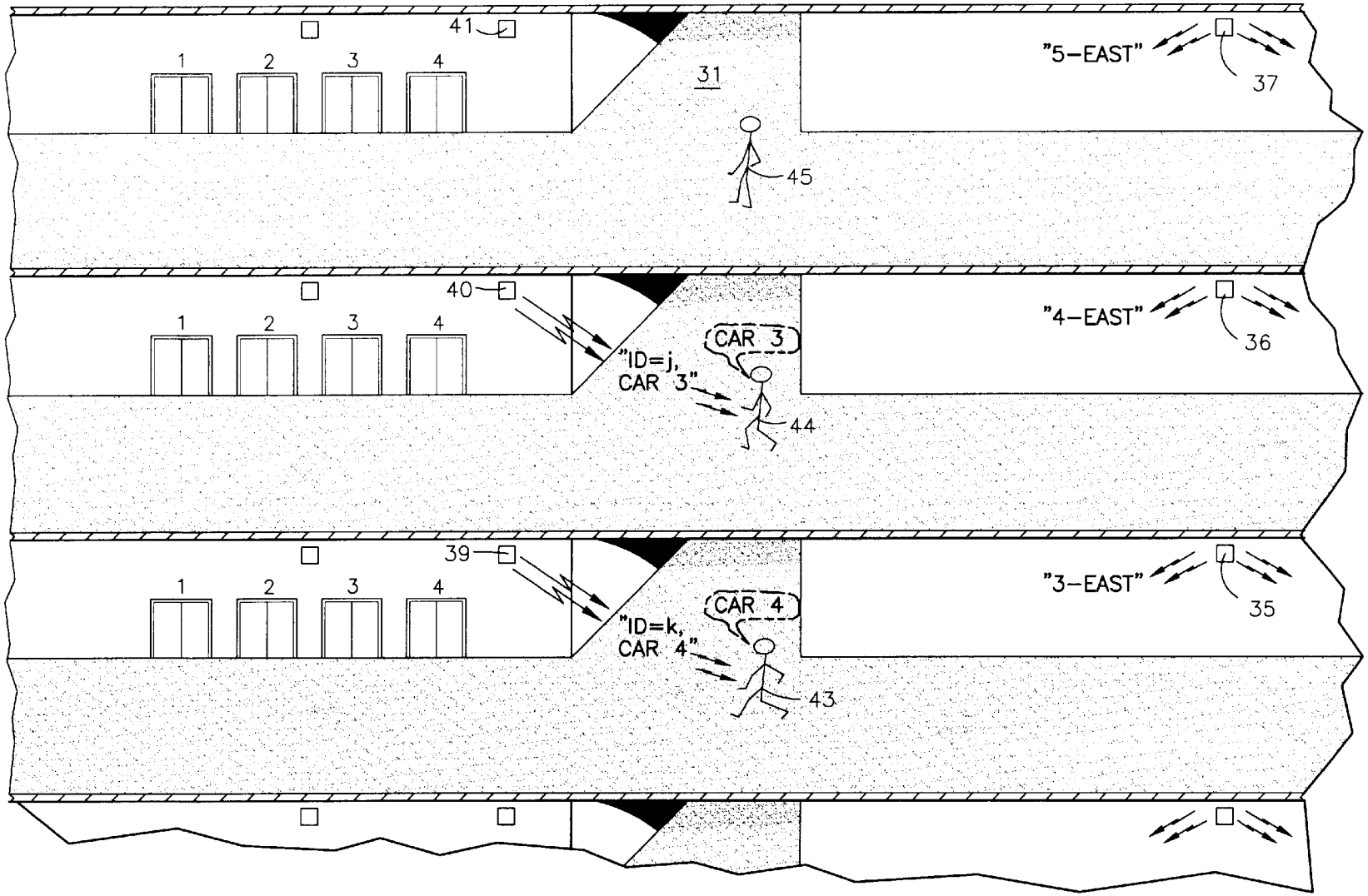

Once the transceivers 39, 40 have received messages indicative of the bearer's verbal response, the dispatcher of the elevator system, which may be any conventional dispatcher, enters a hall call for the corresponding floor (that is, floor 3 for person 43 and floor 4 for person 44), and also enters a destination request for the indicated floor (floor 9 for person 43) or the default floor if no request were made (for instance, floor 14 for person 44). The destination request is used in the dispatcher for making call allocations, but is not entered as a car call until the car stops at the origin floor, or preferably, until the related passenger enters the cab. The dispatcher selects which of the elevators (car 1–car 4) is the most appropriate to respond to the combined hall call/car call. Once the assignment is made, it is communicated to the transceiver 39, 40 of the floor corresponding to the hall call (floor 3 and floor 4, respectively). In turn, each transceiver 39, 40 electromagnetically transmits a corresponding message which identifies the ID of the device entering the call request. Thus, the transceiver 39 transmits a message including the information: the ID of the device requesting the call is k, and the call has been assigned to car four. Similarly, the transceiver 40 transmits a message including that the ID is j, and the call has been assigned to car 3. In response, the verbal remote control device utilizes voice synthesis to announce the car assignment for the call through a loudspeaker to the bearer thereof as shown in FIG. 3. Thus, the verbal remote control device borne by the person 43 announces "car 4", and the verbal remote control device borne by the person 44 announces "car 3". Of course, no announcement is made to the person 45, who begins to turn the corner into the additional corridor 31.

Figure 4:
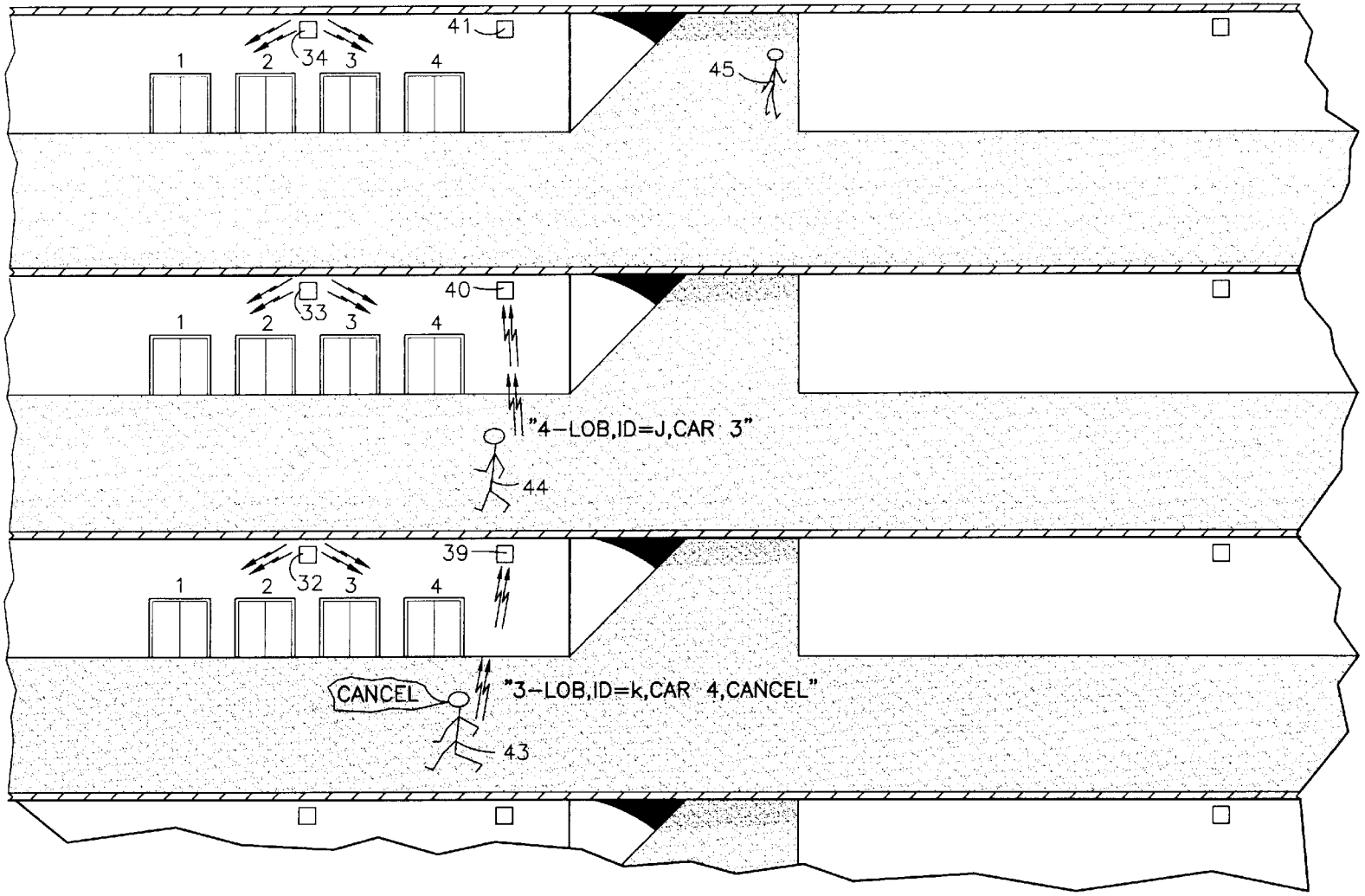

At this point in the sequence, the hall calls are all entered in cars for the pick up floors, the destination floors are noted, and the dispatcher knows the identification number of the persons (devices) who have requested those calls. As seen in FIG. 4, by the time an intended passenger reaches a corresponding one of the elevator landings 23–25, the verbal remote control device will be in range of a corresponding prompt beacon 32–34. This time, the personal devices which have requested a call (e.g., those on persons 43, 44) need not respond to the beacon by providing a human-perceptible prompt (as in FIG. 1); each device can remember that it has already transmitted a call request. On the other hand, each device within the range of a beacon may provide a human prompt, if desired. In any event, the prompt by the beacons 32–34 will cause any device in the area, which either has previously responded or which now has a response to make, to respond to the prompt, with a new tag to identify the beacon 32–34 to which it is responding. In one embodiment of the invention, the response may include a second tag to identify the elevator car to which the related call was assigned. Thus, the device on person 44 (FIG. 4) responds to a prompt from beacon 33 with "4-Lobby, ID=j, CAR 4". The interfloor transmission of messages, as illustrated in FIG. 2, has not been shown in FIG. 4 for clarity.

This transmission with the lobby tag acts as a confirmation of the call, in accordance with the invention set forth in the aforementioned application Ser. No. 09/189,161. Assuming that no other passengers are to be picked up on the fourth floor at this time, in the event that such call by passenger 44 were not confirmed by the indication of person 44 being present at the elevator lobby, by virtue of the lobby beacon tag in the response of his personal device, then, when elevator car 3 reaches the stop control point for the fourth floor without confirmation of the call, the hall stop will be cancelled so as to avoid a false stop. Of course, if other passengers have requested service from or to the fourth floor, then the car will stop for them if they are present at the lobby or in the car. When the hall stop is cancelled because the passenger is not present to be picked up by the first car which was assigned to the call, several options are available. In one embodiment, if car 3 had no passengers and no other hall calls assigned to it, it could simply wait at floor 4 until it had further demand, which could in fact be the appearance of passenger 44. If car 3 had other present demand, the call, including the pickup floor and the destination floor, could simply be reassigned to some other car in the usual fashion. Before or after reaching the landing 23, if the person 43 said "cancel as in FIG. 4", the verbal remote control device borne by him would transmit a message cancelling the hall call and destination call requested on floor 3, assigned to car 4, for the person whose device ID number is k. On the other hand, instead of cancelling the call, the person 43 could have said "19" or "office" to change the call. An important aspect of the aforementioned application Ser. No. 09/111,077 is that voice reception by a unique device allows matching each new request with a specific previous request which must be concomitantly changed.

Transmission of the car assignment tag allows confirmation of which car the device announced to the user (e.g., "car 4", "car 3"). It also provides a link between the device requesting elevator service and the car assigned to that service. This can be utilized within a dispatcher as another way to ensure mitigation of any mixup between elevator service requests, users, and assigned cars. For instance, at a busy time on a busy floor, many devices may be transmitting at the same time, and receiving messages, one after the other. In addition to techniques such as spread spectrum and random time transmissions, the opportunity to mix portions of different messages, thereby incorrectly correlating device, service request and assigned car, can be mitigated by carrying the car assignment along with all messages made following the car assignment. This is another aspect of the present invention.

Figure 5:
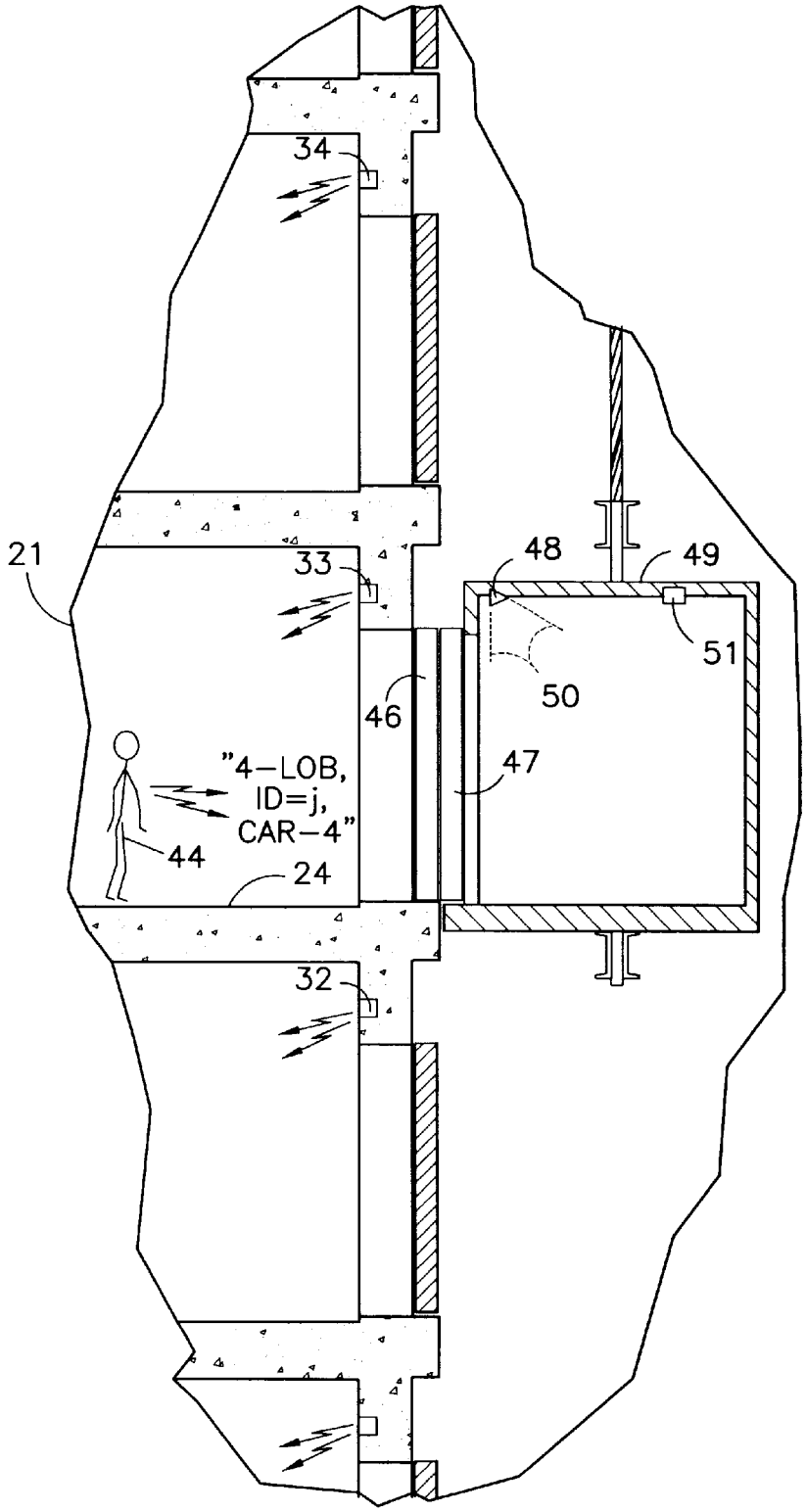
FIGS. 5 and 6 are partial, partially sectioned side elevation views of the elevator lobbies of FIGS. 1–4 illustrating additional sequences in accordance with the present invention.
Figure 6:
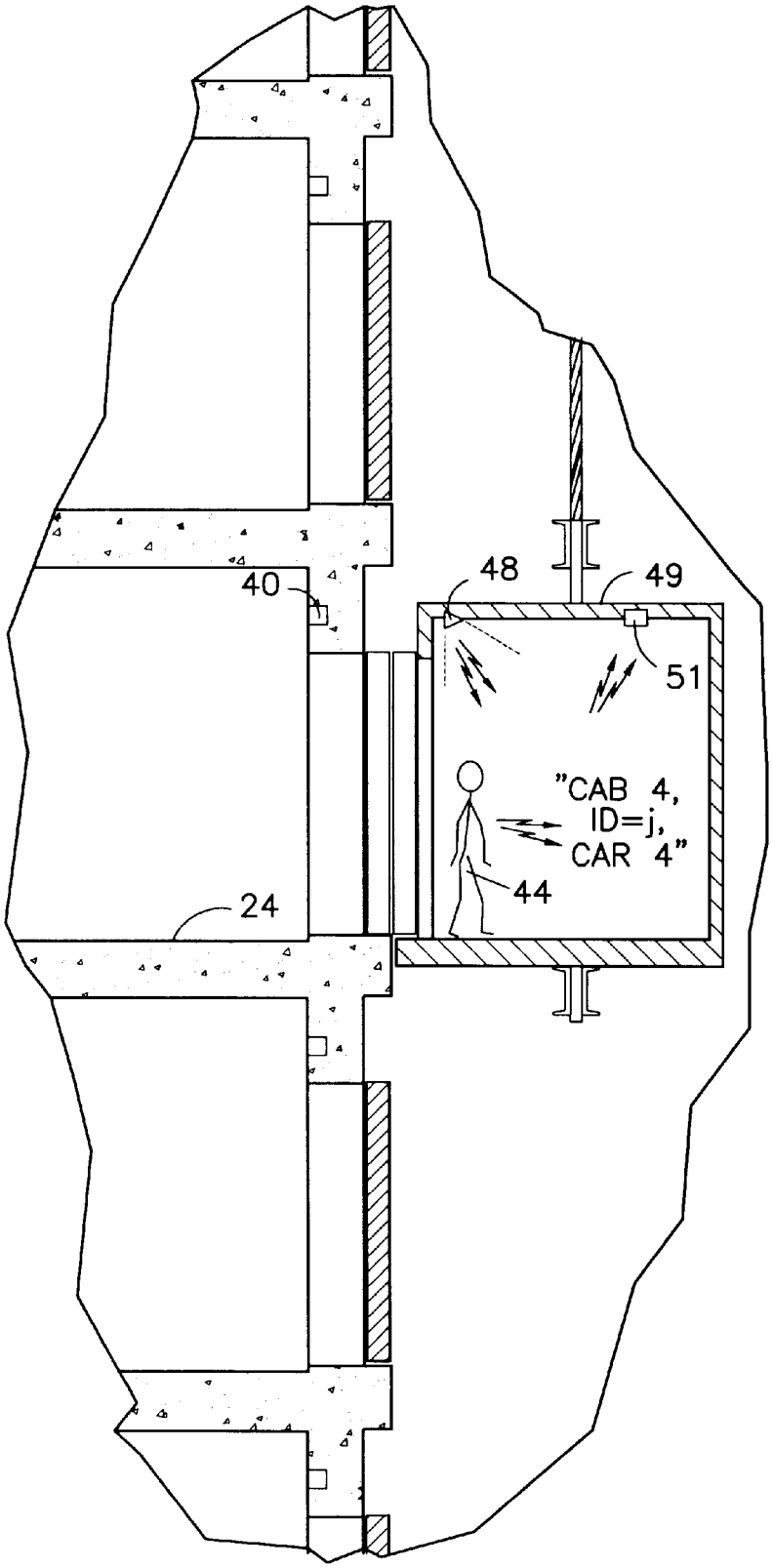

Referring now to FIG. 5, the person 44 is standing at the landing 24 waiting to enter elevator car 3, the fourth floor hoistway doors 46 and elevator doors 47 of which have just opened. The beacons 32–34 at the lobby should be of limited power and/or have directional sensitivity so as to not excite any personal devices within an adjacent elevator cab with the doors open. In FIG. 6, a beacon 48 within the cab 49 of elevator 3 is directional, as indicated by the dotted lines 53. This is to prevent the beacon 48 from prompting the remote control device on the person 44, prior to the person 44 entering the cab 52. Once the beacon 48 prompts the device on person 44, it responds indicating it is in cab 4, the ID is j, and it was assigned to car 4.

When a transceiver 51 receives transmissions from the device borne by the person 44, with the cab 4 locator tag, it is known that the person is within the cab 52. The presence of the identified passenger within the cab 49 is utilized to confirm the destination portion of the request for service, and causes the dispatcher to enter a car call for elevator car 3, which for the person 44 in the example herein will be the default floor for that person.

Thus, the invention provides tags which allow sensing the presence of the passenger at the lobby, that is, in the immediate vicinity of the elevator, to verify the hall call portion of the request for elevator service and cause the elevator car to stop at the origin floor, and to sense presence of the passenger within the elevator cab to verify the destination portion of the hall call and enter a car call for the requested floor, which isolate messages to correct floors, and which correlate passengers, calls, and assigned cars.

If the passenger does not enter the cab after a hall stop is made to pick up that passenger, the elevator system may employ different options. For instance, the call may simply be cancelled, or the call may be assigned to some other car, one or more times, depending on the nature of service which is desired.

The transceiver on each floor may be receptive only to messages from devices which bear the corresponding floor tag. An alternative equivalent way to achieve the same result is to allow the transceivers on each floor to receive messages from any floor and pass them along to the central dispatcher, and have the dispatcher simply enter the call for service to the origin floor identified in the call message, regardless of which receiver receives it. Thus, the response may be selective at the transceiver or at the dispatcher.

The various tags may be used independently: the floor tag (3, 4) may be used to isolate transmissions and/or to identify the pick-up floor, together or separately, with or without the location tag (east, lobby, cab), and those may be used with or without the car assignment tag.

The aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method for remotely entering calls for service by selected ones of a plurality of elevators between floors of a structure, comprising:

(a) transmitting an electromagnetic beacon prompt message successively from a beacon on each one of said floors, each of said prompt messages including a floor message portion identifying the floor on which the corresponding beacon is located;

(b) receiving one of said prompt messages in any one or more of a plurality of portable devices, each device being borne by a potential passenger of said elevator, a corresponding one of said prompt messages being received in any of said devices which are in the immediate vicinity of any one of said beacons; and (c) transmitting, from any one of said devices to which the corresponding potential passenger has indicated a desire for elevator service, in response to receipt of said one prompt message, an electromagnetic call message requesting elevator service for the potential passenger bearing said one device, said call message including a message portion comprising a floor tag identifying the floor identified by the floor message portion of said one prompt message.

2. A method according to claim 1, further comprising:

(d) receiving said call message on one or more of said floors; and (e) responding to said floor message with respect only to the floor identified by said floor tag.

3. A method according to claim 1, further comprising:

(f) assigning a selected one of said elevators to stop at the one floor identified by said floor tag.

4. A method according to claim 3 wherein said call message includes a passenger identification portion, further comprising:

(g) transmitting after said step (f) an assignment message having an assignment message portion identifying said selected elevator and having said passenger identification portion identifying said one device; and (h) transmitting from said one device, in response to receipt thereby of one of said beacon prompt messages after said step (g), a message including a message portion comprising an assignment tag identifying said selected elevator and said passenger identification portion.

5. A method for remotely entering calls for service by selected ones of a plurality of elevators between floors of a structure, comprising:

(a) transmitting, from any one or more of a plurality of portable devices being borne by potential passengers of said elevator for which the corresponding potential passenger has indicated a desire for elevator service, an electromagnetic call message requesting elevator service for the potential passenger bearing said one device, said call message including a message portion comprising a floor tag identifying the origin floor;

(b) transmitting an electromagnetic cab beacon prompt message from a beacon on each one of the cabs of said plurality of elevators, each of said cab beacon prompt messages including a cab message portion identifying the elevator cab on which the corresponding beacon is located;

(c) transmitting, in response to receipt of said cab beacon prompt message, from any device receiving said cab beacon prompt message, an additional call message, each of said call messages and additional call messages including a device message portion identifying each corresponding device; and (d) closing a door of the cab of said selected elevator when stopped at said one floor in response to receipt of an additional call message with said cab tag of said selected elevator being received from each device from which a call message had previously been transmitted with a floor tag for said one floor.

6. An elevator system comprising a plurality of elevators for serving a plurality of floors in a structure, comprising:

a plurality of beacons, at least one beacon on each of said floors, each beacon periodically transmitting a beacon prompt message including a floor message portion indicative of the floor on which the corresponding beacon is located;

a plurality of portable devices, each borne by a potential passenger of said elevators, each device settable to a first condition indicative of the corresponding potential passenger requesting elevator service and settable to a second condition indicative of the corresponding potential passenger not requesting elevator service, each responsive to a beacon prompt transmitted in the vicinity thereof, when in said first condition, to transmit a call message including a message portion comprising a floor tag indicative of the floor indicated by said floor message portion;

a plurality of receivers, one on each of said floors; and a controller responsive to said receivers to enter calls for elevator service in response to said call messages, each call for elevator service including an origin floor identified by the corresponding one of said floor tags.

7. A system according to claim 6 wherein:

said elevators each have a cab with a door; further comprising:

a plurality of cab beacons, one disposed in each of said cabs, each transmitting a cab beacon prompt message including a cab message portion identifying the one of said elevators corresponding to said cab; and wherein:

said devices each respond to receipt of a cab beacon prompt message to transmit a further call message including a message portion comprising a cab tag identifying the cab identified in said call message portion;

each of said call messages includes a message portion identifying the corresponding device; and said controller is responsive to receipt of a further call message including a cab tag portion identifying a cab at a given floor, from each device for which said controller had entered a call for elevator service at said given floor, to close the door of said cab.

8. A method for remotely entering calls for service by selected ones of a plurality of elevators between floors of a structure, comprising:

(a) transmitting an electromagnetic beacon prompt message successively from a beacon on each one of said floors, each of said prompt messages including a floor message portion identifying the floor on which the corresponding beacon is located;

(b) receiving one of said prompt messages in any one or more of a plurality of portable devices, each device being borne by a potential passenger of said elevator, a corresponding one of said prompt messages being received in any of said devices which are in the immediate vicinity of any one of said beacons;

(c) transmitting, from any one of said devices to which the corresponding potential passenger has indicated a desire for elevator service, in response to receipt of said one prompt message, an electromagnetic call message requesting elevator service for the potential passenger bearing said one device, said call message including a message portion comprising a floor tag identifying the floor identified by the floor message portion of said one prompt message;

(d) transmitting an electromagnetic cab beacon prompt message from a beacon on each one of the cabs of said plurality of elevators, each of said cab beacon prompt messages including a cab message portion identifying the elevator cab on which the corresponding beacon is located;

(e) transmitting, in response to receipt of said cab beacon prompt message, from any device receiving said cab beacon prompt message, an additional call message, each of said call messages and additional call messages including a device message portion identifying each corresponding device; and (f) closing a door of the cab of said selected elevator when stopped at said one floor in response to receipt of an additional call message with said cab tag of said selected elevator being received from each device from which a call message had previously been transmitted with a floor tag for said one floor.

* * * * *